United States Patent [19]

De Forrest

[11] Patent Number: 4,599,875

[45] Date of Patent: Jul. 15, 1986

[54] GATE LOCK STRUCTURE

[76] Inventor: William De Forrest, 1825 Via Burton, Anaheim, Calif. 92806

[21] Appl. No.: 639,011

[22] Filed: Aug. 9, 1984

[51] Int. Cl.[4] ..... E05B 65/08

[52] U.S. Cl. ..... 70/95; 70/54

[58] Field of Search ..... 70/95, 96–100, 70/89–90, 38 R, 38 A, 38 B, 38 C, 39, 26, 54–56, 32–34

[56] References Cited

U.S. PATENT DOCUMENTS

| | | | |
|---|---|---|---|
| 3,945,228 | 3/1976 | Voegeli | 70/80 |
| 4,112,716 | 9/1978 | Wippich | 70/39 |
| 4,170,885 | 10/1979 | Lundgren | 70/97 |
| 4,234,220 | 11/1980 | Finch | 70/39 |
| 4,438,641 | 3/1984 | Levkov | 70/95 |

FOREIGN PATENT DOCUMENTS

| | | | |
|---|---|---|---|
| 621430 | 11/1935 | Fed. Rep. of Germany | 39/ |

*Primary Examiner*—Robert L. Wolfe

*Attorney, Agent, or Firm*—K. H. Boswell

[57] ABSTRACT

A locking device for connecting a first structure to a second structure has a lock body receptacle attaching to one of the structures. The lock body receptacle has a hollow interior and includes an opening allowing the insertion of a padlock type lock body into the interior of the receptacle. The face of the receptacle which overlaps the top of the padlock type lock body includes a first and second openings which are positioned so as to align with the corresponding two openings in the top of the padlock type lock body. The opposite face of the receptacle includes an opening allowing for access to the keyway of the padlock type lock body. A shank support member is connected to the other structure. The shank support member includes at least one shank which is positioned in a location on the support member so as pass through one of the openings in the lock body receptacle and into the appropriate opening in the top of the padlock type lock body to lock the shank to the padlock type lock body.

8 Claims, 8 Drawing Figures

GATE LOCK STRUCTURE

BACKGROUND OF INVENTION

This invention is directed to a locking device where a first and second structure such as a gate enclosure can be locked together. The locking device can utilize the existing body of padlock type lock body to supply the locking mechanism for the device.

It is desirable in many situations to enclose the perimeter of an area with a fence or wall and to utilize a gate for ingress and egress into the area. Such a system is utilized to provide security for such installation such as parking lots, storage yards and construction sites and the like.

More often than not whether a swinging gate, rolling gate or a sliding gate is utilized, the gate is secured to a post or a second gate component utilizing a chain and a padlock. Padlocks can be purchased which are engineered to include extremely hard materials for both the lock body and the shank. These are extremely resistant to hacksaws, bolt cutters and the like. Unfortunatly the use of a chain in combination with the padlock provides a "weak link". The steel which is utilized in a chain in order to provide strength for the chain generally is not hardened to the extent that the steels which are utilized in padlocks are. Because of this most chains can be easily severed with bolt cutters, hacksaws, or the like. The strongest lock available therefore will have little effect to deterring entrance to a secured enclosure if it is utilized with a chain which is easily severed.

In many instances such as in public storage yards it is desirable to provide master keys for security forces and the like which, in making their daily rounds, need to enter and exit many different locks. It is undesirable however, because of the necessity for public distribution of public user keys to "key" numerous storage yards or the like with similar keys. This results in a dicotimee between on one hand the need to distribute a limited number of "master keys" and on the other hand a need to distribute a large variety of public user keys.

BRIEF DESCRIPTION OF THE INVENTION

In view of the above it is an object of this invention to provide a locking device which is suitable for connecting a first structure to a second structure. It is a further object of this invention in the preferred form of the invention to provide a locking device which can utilize the body of a padlock type lock as locking component of the device. Because, of this it is an additional object of this invention to provide a locking device which results in maintaining a more secure manner of a locking one structure to the other without resorting to expensive customized locks for the particular structure. It is a further object of this invention to provide in an embodiment of the invention a locking device which includes a first and second lock one of which can be master keyed and the second of which can serve as a public use key for the facility being secured.

These and other objects which will become evident from the remainder of this specification are achieved in a locking device for connecting a first structure to a second structure which comprises: a lock body receptacle, said receptacle having at least first and second opposing faces, said lock body receptacle having a hollow interior, said interior separating said first and said second faces; mounting means for attaching said lock body receptacle to said first structure; said first face including a first face opening, said hollow interior of said lock body receptacle sized and shaped so as to contain a padlock type lock body with the keyway of said padlock type lock body exposed through said first face opening allowing manipulation of a key in said keyway, said second face including at least one second face opening, said second face openings sized and shaped and positioned on said first face so as to align with one of a first and second shank opening located on said padlock type lock body when said padlock type lock body is located within the interior of said lock body receptacle; means located on said lock body receptacle for inserting said padlock type lock body into the interior of said lock body receptacle; a shank support member, said shank support member including at least a first lock shank located thereon, said lock shank sized and shaped and located on said shank receptacle in a position so as to fit through said second face opening and into said shank opening located on said padlock type lock body which is align with said second face opening when said padlock type lock body is located within the interior of said lock body receptacle, said lock shank further including means located thereon for coupling with said padlock typed lock body to lock said shank support member to said lock body receptacle; means for attaching said shank support member to said second structure.

In one of the illustrated embodiments of the invention shown herein, the same opening is utilized for the insertion of the padlock type lock body into the interior of the lock body receptacle and for allowing access to the keyway of the padlock type lock body. A small set screw can be utilized as a retaining means to retain the padlock type lock body afixed within the lock body receptacle.

A high security padlock known as a toe and heel locking dog utilizes a locking mechanism between the body of the padlock in both sides of a U-shaped shank associated with the body. It is preferred to utilize a padlock of this nature for the padlock type locking body and in doing so to include a first and second face opening in the second face of the lock body receptacle to accept two shanks into the interior of the lock body receptacle to engage with the padlock type lock body located therein.

In an illustrative embodiment of the invention, a skirt is utilized on the shank support member. The skirt fits over the lock body receptacle when the shank or shanks of the shank body support member are inserted into the openings in the second face of the lock body receptacle. The presence of the skirt shields the shank or shanks against cutting, chiseling or the like when they are locked to the lock body receptacle.

In a further embodiment of the invention, two lock body receptacles can be utilized with one attaching to one of the structures being locked together and the other attaching to the other of the structures being locked together. A shank support member having a central element and at least one right side shank and one left side shank are utilized to couple the two lock body receptacles together. One of the lock body receptacles can include a lock which is opened via a the master key or the like and other of the lock body receptacles conclude a lock for which public access keys are distributed. Depending upon which lock is opened, the central element will remain attached to the other lock body receptacle.

In a further embodiment the first and second lock body receptacles utilized could include other locking mechanisms other than a padlock type lock body. Preferably these other mechanisms might include cylinder type locks and the like. These other mechanisms might also include a changeable cylinder lock which can be conveniently rekeyed at intervals in order to inhibit access to users no longer having authority to gain access to the public storage facility or the like.

BRIEF DESCRIPTION OF THE DRAWINGS

This invention will be better understood when taken in conjunction with the drawings herein.

Figure 1:
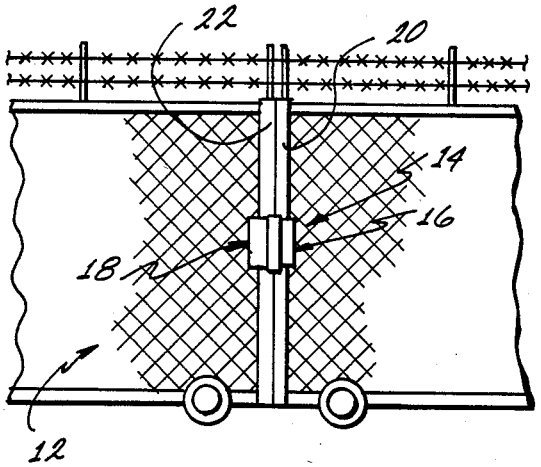
FIG. 1 is an elevational view of a typical sliding gate (rolling gate) including the locking device of the invention located thereon in the central portion of the figure.

The invention described in this specification and illustrated in the drawing utilizes certain principles and/or concepts as are set forth in the claims appended to this specification. Those skilled in the locksmithing arts will realize that these principles and/or concepts are capable of being utilized in a variety of embodiments which might differ from the embodiments illustrated and described herein. For this reason this invention is not to be construed as being limited to only the illustrative embodiments but should only be construed in view of the claims.

DETAILED DESCRIPTION OF THE INVENTION

FIG. 1 shows a right side rolling gate 10 and a left side rolling gate 12 which are utilized to open and close the access to a restricted area which would be surrounded by a fence, not separately numbered or shown. The right and left side gates 10 and 12 are lockable to one another utilizing the locking device 14 shown in the center of the figure.

Figure 2:
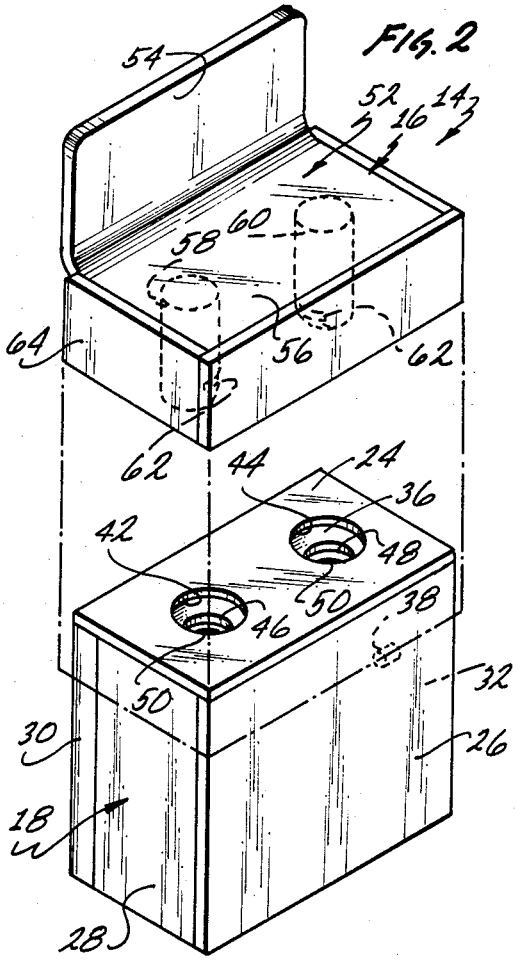
FIG. 2 is an exploded isometric view of one embodiment of the invention.

The locking device 14 is actually made up of two components which are best seen in FIG. 2. These include a shank support member 16 and a lock body receptacle 18. For the locking device 14 shown in FIG. 1 the shank support member 16 could be welded to the gate post 20 of the right side rolling gate 10 and the lock body receptacle 18 could be welded to gate post 22 of the left side rolling gate 12. Alternate methods of attaching both of these components, the shank support member 16 and the lock body receptacle 18, are discussed below and are shown in other figures as will be described later. Additionally, of course the shank support member 16 could be located on the gate 12 and the lock body receptacle 18 could be located on the gate 10.

Figure 3:
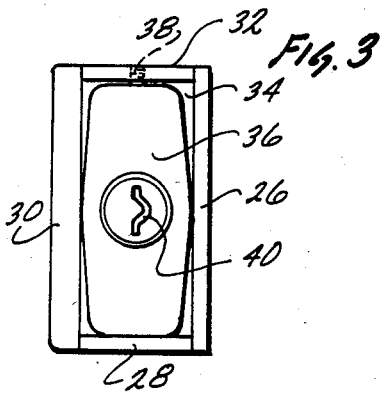
FIG. 3 is a bottom plan view of the lower component of FIG. 2.
Figure 7:
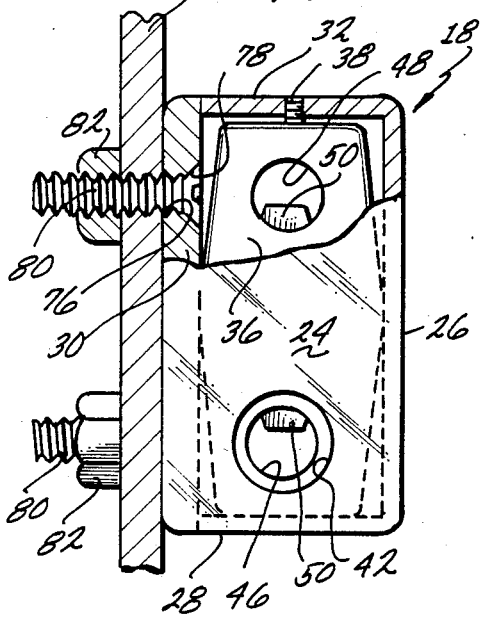
FIG. 7 is an elevational view in partial section of the lower most component of FIG. 2 showing mounting of this component to a gate structure.

The lock body receptacle 18 is shown in FIGS. 2 and 3 and a modification is shown in FIG. 7. The modification of FIG. 7 however, utilizes the same basic components as are shown in FIGS. 2 and 3 and as such like numerals are utilized for like parts in these figures.

The lock body receptacle 18 is essentially formed as a box with one of its sides missing. It includes a top or first side 24 and then two sets of mutually parallel sides 26,28,30,32. The bottom 34 which would constitute the sixth side of the box is open allowing for access to the interior of the lock body receptacle 18. The wall 30 is generally made with slightly thicker material then the remainder of the walls as to facilitate mounting of the lock body receptacle 18.

A padlock type lock body 36 preferably of the type commonly known as a toe and dog type lock is located within the interior of the lock body receptacle 18. It is easily inserted into this interior by simply passing it through the open end 34. This type of lock body is utilized in the padlock type locks wherein the shank of the lock which is generally U-shaped in structure is completely removable from the body of the lock. That is each of the two arms of the U-shaped shank are releaseable from the main part of the lock body 36. In any event the padlock a lock body 36 is positioned within the lock body 18.

A small setscrew 38 located within a threaded hole in wall 32 is utilized to fix the padlock lock body 36 within the interior of the lock body receptacle 18. This holds the padlock lock body 36 within the interior such that it doesn't become inadvertently dislodged from the interior of the lock body receptacle 18 when the locking device 14 is unlocked. When the locking device 14 is locked as hereinafter explained the locking of the locking device 14 itself will secure the padlock lock body 36 to the interior of the lock body receptacle 18 irrespective of the presence of or the absence of the setscrew 38. The setscrew 38 is simply a convenience feature to maintain the padlock lock body 36 in a fixed position within the lock body receptacle 18.

The opened bottom 34 of the lock body receptacle 18 aside from serving to allow for insertion and removal of a padlock lock body 36 into the interior of the lock body receptacle 18 also exposes the keyway 40 of the padlock type lock body 36. This allows a key to be inserted into and removed from the keyway 40 allowing for locking and unlocking of the padlock type lock body 36 to a shank as hereinafter explained. Anyone of a number of commercially available padlock lock bodies 36 are suitable for use as the locking mechanism within the lock body receptacle 18. In view of this a detailed description of the locking mechanism of the padlock lock body 36 is not necessary to the understanding of this invention.

With the exception of the top side 24, any of the other sides 26,28,30,32 could include an appropiate opening for allowing insertion of the padlock body 36 into the lock body receptacle 18. If this was done, a solid side would be located along the bottom 34 with this side including a small opening allowing for exposure for the keyway 40 for insertion and removal of the key therein. It is however more convenient simply to provide the bottom 34 as an open side allowing for both insertion of the padlock lock body 36 into the interior of the lock receptacle 18 and exposure of the keyway 40.

The top side 24 includes two openings 42 and 44 located therein. These are sized, shaped and positioned within the top side 24 such that they align with appropriate openings 46 and 48 formed in the top of the padlock lock body 36. This allows for insertion of an appropriate shank or shanks into the body of the padlock lock body 36 so as to lock with locking dogs collectively identified by the numeral 50 located within the padlock lock body 36.

FIG. 2 shows one embodiment of the shank support member 16. This embodiment is primarily designed to be welded onto an appropriate gate post such as post 20 to attach it to an appropriate gate such as the gate 10. It includes an L-shaped face plate 52 having a first section 54 for attaching to the appropriate gate post and a second section 56. Attached to the inside surface of the section 56 are first and second shank members 58 and 60. They are designed to fit through the appropriate openings 42,44,46,48 such that they can be inserted into the padlock lock body 36 and interact with the locking dogs 50 within the padlock lock body 36 to fix the shank support member 16 to the lock body receptacle 18. Each of the shanks 58 and 60 include a small undercut area collectively identified by the numeral 62 which allows for locking with the locking dogs 50.

The shanks 58 and 60 are appropriately connected to the section 56 of the base plate 52 by welding or other suitable permanent fastening means. Alternately, the totality of the base plate 52 and the shanks 58 and 60 could be formed as a one piece intricately formed cast member. In any event the shanks 58 and 60 will be so joined to the base plate 52 so as to form an extremely strong structural unit.

Surrounding the shanks 58 and 60 is a three sided skirt 64. The skirt 64 is sized such that it is capable of fitting around the top part of the lock body receptacle 18 when the shanks 58 and 60 are locked to the padlock lock body 36. This essentially hides and shields the shanks 58 and 60 so that a hacksaw blade or the like cannot be inserted between the top wall 24 of the lock body receptacle 18 and the section 56 of the base plate 52 in order to saw through the shanks 58 and 60. The back side of the skirt 64 is left open insofar as this abuts against the gate post 20 and is shielded gate post 22 when the locking device 14 is locked.

Figure 4:
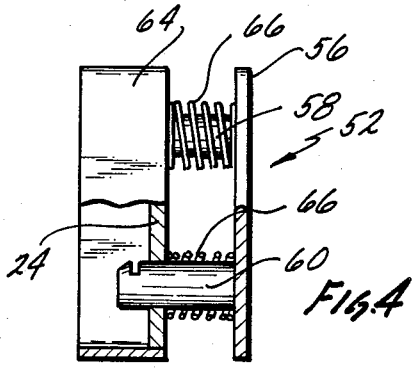
FIG. 4 is a side elevational view in partial section of a fragmentary portion of one embodiment of the invention.

In FIG. 4, two springs collectively identified by the numeral 66 have been placed around the shanks 58 and 60. These are appropriately spot welded or the like to the underside of the section 56 of the base plate 52 to retain them against the base plate 52. The springs 66 serve to spring load the locking device 14 such that when it is unlocked, the lock body receptacle 18 is pushed away from the shank support member 16. Because of the presence of the skirt 64 it is not necessary for the underside of the section 56 of the base plate 52 to directly contact the top wall 24 of the locking receptacle 18. As such there is ample room for the springs 66 in a compressed state when the shank support member 16 is locked to the lock body receptacle 18.

Figure 5:
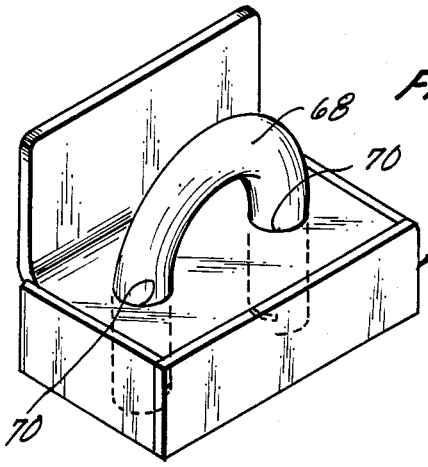
FIG. 5 is an isometric view of a further embodiment of one of the components of the invention.

In FIG. 5 an alternate embodiment is shown for the shank support member. The shank support member 67 shown in FIG. 5 differs from the shank support member 16 shown in FIG. 2 in that a continuous U-shaped shank 68 is utilized. The appropriate ends of this shank 68 are inserted through openings collectively identified by the numerals 70 formed in the shank support members 67. The shank 68 can be the original equipment shank which was included as a part of the padlock from which the padlock lock body 36 was obtained. Because of the U-shape of the shank 68 it is impossible to pull the shank 68 from the shank support member 67 when the shank support member 67 is locked to the lock body receptacle 18. Insofar as a portion of the shank 68 is exposed it is preferred to utilize the shank support member 18 for high security situations. In those security situations however which warrant the economical use of the shank 68 over the added security provided by the shank support member 16 the embodiment of FIG. 5 would be utilized.

Figure 6:
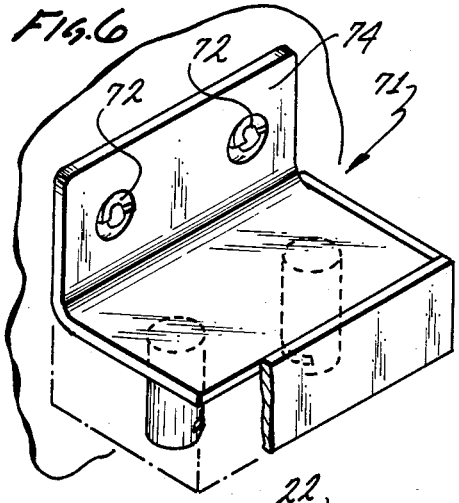
FIG. 6 is an isometric view in partial section, similar to FIG. 4 of a further embodiment of one of the components of the invention.

In FIG. 6 a further embodiment of a shank support member is shown. The shank support member 71 shown in FIG. 6 differs from the shank support member 16 in the method of attachment of the same to an appropriate gate post such as gate post 20. For the embodiment of FIG. 6 two one way screws, collectively identified by the numeral 72 are utilized to attach the base plate 74 to an appropriate gate post or the like. The base plate 74 has appropriate openings drilled therein to allow for insertion of the one way screws 72. The screws 72 are the type which can be tightened utilizing a special screwdriver, however, their heads design are such that they cannot be removed. Other than the use of the one way screws 72 the shank support member 71 is identical to that for the shank support member 16.

In FIG. 7 the lock body receptacle 18 has been modified to include two passage ways only one of which can be seen, passage way 76 through the side wall 30. The other passage way is of course identical to that one shown. Where the passage way 76 opens up into the interior of the lock body receptacle 18, a countersunk surface 78 has been formed. This allows for insertion of a screw or bolt from the interior of the lock body receptacle 18 through the passage way 76 with the remainder of the screw or bolt then located on the outside of side 30. Once screws or bolts such as screws 80 are so located within the passage way 76 and the padlock lock body 36 is inserted into the interior of the lock body receptacle 18 the presence of the padlock lock body 36 prevents removal of the screws 80 from the lock body receptacle 18.

In the embodiment of FIG. 7 two nuts collectively identified by the numeral 82 have been welded to the inside surface of a support member 84 to which the lock body receptacle 18 is mounted. The screws 80 are then inserted through the interior of the lock body receptacle and screwed through the support member 84 into the nuts 82 welded thereon. It is preferred to tap the passage way through the support member 84 such that the screws 80 not only engaged with the nuts 82 but also engage within the interior of the passage way through the support 84. In any event once the padlock body 36 is inserted within the interior of the lock body receptacle 18 it is impossible using vice grips or the like to remove the screws from the support member 84 by turning the end 86 of the screw which is exposed. Of course the end 86 could be cut flush with outside surface of the nuts 80 to prevent any attempt of removal of the lock body receptacle 18 from the support surface 80.

Figure 8:
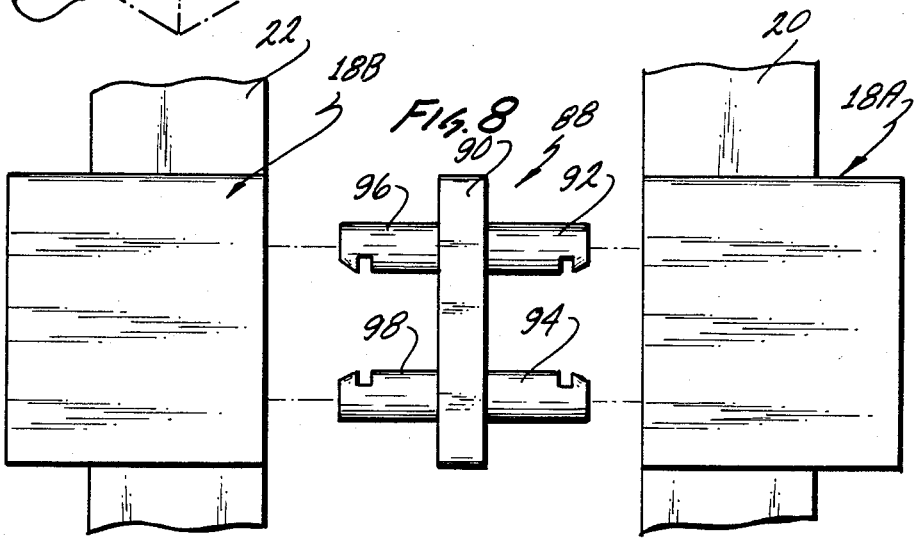
FIG. 8 is a front elevational view of a further embodiment of the invention.

In FIG. 8 two identical lock body receptacles 18 have been appropriately mounted to the gate post 20 and 22. A first padlock lock body would be inserted into the receptacle 18A and a second into the receptacle 18B. These could be keyed to different keys such that, one of these say for instance the padlock lock body in receptacle 18B could be master keyed whereas the one in receptacle 18A would include keys which would be distributed to appropriate users of the area which was being secured. For instance at a public storage yard or the like, the key to the padlock in the lock body receptacle 18*b* would be given to security and management with the keys to the padlock lock body in lockbody receptacle 18A then distributed to the public users of the storage yard. If for some reason it was determined to distribute new keys for access to the storage yard, only the padlock lock body in the lock body receptacle 18A needs to be changed. The limited distribution of the key for the padlock lock body in lock body receptacle 18B could be maintained. Thus at all times Security and management would be guaranteed access to the secured area but control could be exercised with regard to those key holders having access only to the padlock lock body which is located within the lock body receptacle 18A.

The shank support member 88 utilized in conjunction with the two lock body receptacles 18A and 18B of FIG. 8 includes a central element 90 having two right side shanks 92 and 94 and two left side shanks 96 and 98. Depending upon which padlock lock body in receptacle 18A or the 18B was opened with a key, the shank support member 88 would remain locked to the other padlock lock body in the other receptacle 18A or 18B. When it is desirous to lock the structure to which the gatepost 20 and 22 are mounted thereon the shank support member 88 would be locked to both of the padlock lock bodies which are located in the lock body receptacles 18A and 18B. Access could be gained to this area by either unlocking the padlock lock body in one or another of the lock body receptacles 18A or 18B.

For the embodiment shown in FIG. 8 no skirts are included on the shank support member 88 for clarity of structure. Of course appropriate skirts could be included on both the right and left hand sides of the shank support member 88 to provide for security of the structure as described for the embodiment of FIG. 2.

For all of the embodiments shown in the figures either two shanks 58 and 60 have been utilized or a single shank 68 having two ends have been utilized. It is of course understood that a single shank would suffice to lock with the padlock lock body 36 or any other similar padlock type lock bodies however, the dual shank provides the extra security of doubly locking the shank support member such as shank support member 16 to the lock body receptacle 18.

Padlock type lock bodies 36 have been shown for use in the lock body receptacles 18 because of the ease and convenience. For use with a device such as that shown in the embodiment of FIG. 8 other types of locking mechanisms might also be considered, Each of the lock body receptacles 18A and 18B could be equipped with cylinder locks or the like. Thus in office building or the like which might include swinging or sliding doors, keys for one side of this device might be provided to the tenant and the keys for the other side to security and janitorial personnel. If a large number of these devices were utilized in a building or the like it might be more economical to utilize cylinder type locks which can be rekeyed instead of the padlock lock bodies.

I claim:

1. A locking device for connecting a first structure to a second structure which comprises:

a lock body receptacle, said receptacle having at least first and second opposing faces, said lock body receptacle having a hollow interior, said interior separating said first and said second faces;

mounting means for attaching said lock body receptacle to said first structure;

said first face including a first face opening, said hollow interior of said lock body receptacle sized and shaped so as to contain a padlock type lock body with the keyway of said padlock type lock body exposed through said first face opening allowing manipulation of a key in said keyway, said second face including at least one second face opening, said second face openings sized and shaped and positioned on said first face so as to align with one of a first and second shank opening located on said padlock type lock body when said padlock type lock body is located within the interior of said lock body receptacle;

means located on said lock body receptacle for inserting said padlock type lock body into the interior of said lock body receptacle;

a shank support member, said shank support member including at least a first lock shank located thereon, said lock shank sized and shaped and located on said shank receptacle in a position so as to fit through said second face opening and into said shank opening located on said padlock type lock body which is aligned with said second face opening when said padlock type lock body is located within the interior of said lock body receptacle, said lock shank further including means located thereon for coupling with said padlock typed lock body to lock said shank support member to said lock body receptacle;

means for attaching said shank support member to said second structure, said means for attaching said shank support member to said second structure includes a second lock body receptacle, said second lock body receptacle essentially identical to said first lock body receptacle and including a second padlock type lock body;

said shank support member including a central element, at least a first right side lock shank located on said central element and positioned on said central element to extend to the right side of said central element, at least a first left side lock shank located on said central element and positioned on said central element to extend to the left side of said central element, said right side shank and said left side shank positioned with respect to one another such that said right side shank is capable of passing into said first face opening on said lock body receptacle and said left side shank is capable of passing into said first face opening on said second lock body receptacle.

2. The locking device of claim 1 wherein:

said means for inserting said padlock type lock bodies into the interior of said respective lock body receptacles comprises said first face opening being sized and shaped so as to allow insertion of one of said padlock type lock bodies into the interior of each of said lock body receptacles through said first face opening.

3. The locking device of claim 2 including:

retaining means located on each of said lock body receptacles for holding said padlock type lock body within said interior of said lock body receptacle.

4. The locking device of claim 1 including:

skirt means locating on said shank support member, said skirt means sized and shaped so as to fit over a portion of each of said lock body receptacles when said shanks are located within said second face opening of said respective lock body receptacles, said skirt means for inhibiting the insertion of a foreign object between said shank support member and said lock body receptacles when said shanks are located within said second face opening of said respective lock body receptacles.

5. The locking device of claim 1 wherein:

each of said lock body receptacles include first and second face openings, said first and said second face openings sized and shaped and positioned with respect to one another so as to align with said first and said second shank openings on said respective padlock type lock bodies when said padlock type lock bodies are located within said interiors of said respective lock body receptacles;

said shank support member includes a first and a second right side lock shank and a first and a second left side lock shank located thereon, said respective first and said second lock shanks sized and shaped and located on said shank support member in positions so as to fit through said first and said second face openings and into said first and said second shank openings located on said respective padlock type lock bodies when said padlock type lock bodies are located within the interior of said respective lock body receptacles.

6. A locking structure for connecting a first structure to a second structure which comprises:

a first and second lock body receptacle, said first lock body receptacle connected to said first structure, said second lock body receptacle connected to said second structure;

a locking mechanism located in each of said lock body receptacles, said locking mechanism of the type capable of locking with a shank;

a shank support member including a central element, at least a first right side lock shank located on said central element and positioned on said central element to extend to the right side of said central element, at least a first left side lock shank located on said central element and positioned on said central element to extend to the left side of said central element, said right side shank and said left side shank positioned with respect to one another such that said right side shank is capable of locking with said locking mechanism in said first lock body receptacle and said left side shank is capable of locking with said locking mechanism in said second lock body receptacle.

7. The locking device of claim 7 wherein:

said locking mechanism in both said first and said second lock body receptacles comprises a padlock type lock body located within said receptacles.

8. The locking device of claim 7 including;

first and second right side shanks and first and second left side shanks all located on said central element.

* * * * *

UNITED STATES PATENT AND TRADEMARK OFFICE

CERTIFICATE OF CORRECTION

PATENT NO. : 4,599,875

DATED : July 15, 1986

INVENTOR(S) : WILLIAM DE FORREST

It is certified that error appears in the above-identified patent and that said Letters Patent is hereby corrected as shown below:

The title page should appear as shown on the attached sheet.

Column 2, line 21, "align" should be --aligned--.

Column 2, line 25, "typed" should be --type--.

Column 2, line 64, "conclude" should be --include--.

Column 4, line 12, "then" should be --than--.

Column 4, line 13, delete the word "as".

Column 4, line 25, delete the word "a".

Column 5, line 27, "intricately" should be --integrally--.

Column 5, line 41, after the word "shielded" insert the word --by--.

Column 5, line 63, "members" should be --member--.

Column 6, line 3, the numeral "18" should be --16--.

UNITED STATES PATENT AND TRADEMARK OFFICE

CERTIFICATE OF CORRECTION

PATENT NO. : 4,599,875

DATED : July 15, 1986

INVENTOR(S) : WILLIAM DE FORREST

It is certified that error appears in the above-identified patent and that said Letters Patent is hereby corrected as shown below:

Column 6, line 48, "engaged" should be --engage--.

Column 7, line 20, delete the word "the", first occurrence.

Column 8, line 65, "locating" should be --located--.

Column 10, line 22, the numeral "7" should be --6--.

Signed and Sealed this

Seventeenth Day of February, 1987

*Attest:*

DONALD J. QUIGG

*Attesting Officer*

*Commissioner of Patents and Trademarks*

United States Patent [19]

De Forrest

[11] Patent Number: 4,599,875

[45] Date of Patent: Jul. 15, 1986

[54] GATE LOCK STRUCTURE

[76] Inventor: William De Forrest, 1825 Via Burton, Anaheim, Calif. 92806

[21] Appl. No.: 639,011

[22] Filed: Aug. 9, 1984

[51] Int. Cl.[4] ..... E05B 65/08

[52] U.S. Cl. ..... 70/95; 70/54

[58] Field of Search ..... 70/95, 96–100, 70/89–90, 38 R, 38 A, 38 B, 38 C, 39, 26, 54–56, 32–34

[56] References Cited

U.S. PATENT DOCUMENTS

| | | | |
|---|---|---|---|
| 3,945,228 | 3/1976 | Voegeli | 70/80 |
| 4,112,716 | 9/1978 | Wippich | 70/39 |
| 4,170,885 | 10/1979 | Lundgren | 70/97 |
| 4,234,220 | 11/1980 | Finch | 70/39 |
| 4,438,641 | 3/1984 | Levkov | 70/95 |

FOREIGN PATENT DOCUMENTS

| | | | |
|---|---|---|---|
| 621430 | 11/1935 | Fed. Rep. of Germany | 39/ |

*Primary Examiner*—Robert L. Wolfe

*Attorney, Agent, or Firm*—K. H. Boswell

[57] ABSTRACT

A locking device for connecting a first structure to a second structure has a lock body receptacle attaching to one of the structures. The lock body receptacle has a hollow interior and includes an opening allowing the insertion of a padlock type lock body into the interior of the receptacle. The face of the receptacle which overlaps the top of the padlock type lock body includes a first and second openings which are positioned so as to align with the corresponding two openings in the top of the padlock type lock body. The opposite face of the receptacle includes an opening allowing for access to the keyway of the padlock type lock body. A shank support member is connected to the other structure. The shank support member includes at least one shank which is positioned in a location on the support member so as pass through one of the openings in the lock body receptacle and into the appropriate opening in the top of the padlock type lock body to lock the shank to the padlock type lock body.

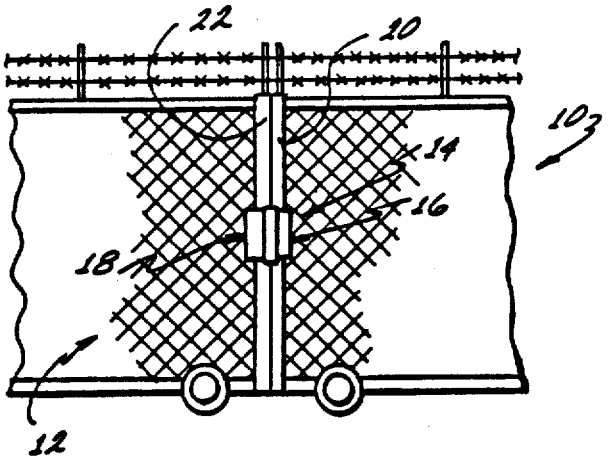

8 Claims, 8 Drawing Figures